US008644730B2

(12) United States Patent
Takagi

(10) Patent No.: US 8,644,730 B2
(45) Date of Patent: Feb. 4, 2014

(54) PROCESS CARTRIDGE

(75) Inventor: Takeyuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 103 days.

(21) Appl. No.: 13/052,882

(22) Filed: Mar. 21, 2011

(65) Prior Publication Data

US 2011/0236060 A1 Sep. 29, 2011

(30) Foreign Application Priority Data

Mar. 24, 2010 (JP) ..... 2010-068575

(51) Int. Cl.
*G03G 21/18* (2006.01)

(52) U.S. Cl.
USPC ..... 399/113

(58) Field of Classification Search
USPC ..... 399/113, 111, 110
See application file for complete search history.

(56) References Cited

U.S. PATENT DOCUMENTS

| | | | | |
|---|---|---|---|---|
| D471,228 | S | 3/2003 | Okabe et al. | |
| D471,583 | S | 3/2003 | Okabe et al. | |
| 2002/0028088 | A1* | 3/2002 | Okabe et al. | 399/113 |
| 2003/0049046 | A1 | 3/2003 | Okabe | |
| 2005/0191090 | A1* | 9/2005 | Nishimura | 399/113 |
| 2006/0029418 | A1 | 2/2006 | Ishii et al. | |
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0029423 | A1 | 2/2006 | Shiraki | |
| 2007/0048007 | A1* | 3/2007 | Kamimura | 399/111 |
| 2009/0180802 | A1 | 7/2009 | Sato et al. | |
| 2010/0303499 | A1* | 12/2010 | Mori et al. | 399/113 |

FOREIGN PATENT DOCUMENTS

| | | | |
|---|---|---|---|
| JP | H04-093849 | U | 8/1992 |
| JP | H09-330687 | A | 12/1997 |
| JP | H02-821427 | B2 | 11/1998 |
| JP | 2001-015936 | A | 1/2001 |

(Continued)

OTHER PUBLICATIONS

Machine translation of JP 09-330687 dated May 15, 2013.*

(Continued)

*Primary Examiner* — Sophia S Chen
(74) *Attorney, Agent, or Firm* — Baker Botts L.L.P.

(57) ABSTRACT

A process cartridge includes: a drum cartridge; a developing cartridge, which holds a developing roller at a first end portion thereof, and which is detachably mounted to the drum cartridge; a lock member, which is provided to the drum cartridge, and which is displaceable between a lock position and a lock release position; an operation member that displaces the lock member to the lock release position; a lifting member that lifts a second end portion of the developing cartridge from the drum cartridge as the lock member is displaced to the lock release position; a developing-side holding part that extends in a direction orthogonal to the lifting direction of the second end portion from the drum cartridge; and a drum-side holding part that extends in parallel with the developing-side holding part while being opposed to the developing-side holding part in the lifting direction when the developing cartridge is mounted.

15 Claims, 7 Drawing Sheets

(56) References Cited

FOREIGN PATENT DOCUMENTS

| | | | |
|---|---|---|---|
| JP | 2002-162797 | A | 6/2002 |
| JP | 2003-084647 | A | 3/2003 |
| JP | 2003-164690 | A | 6/2003 |
| JP | 2004-258693 | A | 9/2004 |
| JP | 2006-184501 | A | 7/2006 |
| JP | 2008-032755 | A | 2/2008 |
| JP | 2010-009075 | A | 1/2010 |

OTHER PUBLICATIONS

Japan Patent Office, Notification of Reason for Refusal for Japanese Patent Application No. 2010-068575 (counterpart Japanese patent application), dispatched Jul. 10, 2012.

The State Intellectual Property Office of the People's Republic of China, Notification of the Second Office Action for Chinese Patent Application No. 201110077190.3 (counterpart Chinese patent application), issued Jan. 21, 2013.

* cited by examiner

5

51

PROCESS CARTRIDGE

CROSS-REFERENCE TO RELATED APPLICATIONS

This application claims priority from Japanese Patent Application No. 2010-068575 filed on Mar. 24, 2010, the entire subject matter of which is incorporated herein by reference.

TECHNICAL FIELD

The present invention relate to a process cartridge that is detachably mounted to an image forming apparatus.

BACKGROUND

In an image forming apparatus such as a laser printer, it is known that a developing cartridge holding a developing roller is mounted to a drum cartridge holding a photosensitive drum, and these cartridges are then integrally mounted, as a process cartridge, to a main body of the apparatus.

In an example of the process cartridge, the drum cartridge has a developing cartridge housing part. The photosensitive drum is arranged at one side of the developing cartridge housing part and faces the developing cartridge housing part. In the meantime, the developing roller is provided to one end portion of the developing cartridge so that a part of a circumferential surface thereof is exposed to an outside.

When mounting the developing cartridge to the drum cartridge, the developing cartridge is arranged above the developing cartridge housing part so that the developing roller contacts the photosensitive drum. As the other end portion opposite to the side of the developing cartridge to which the developing roller is provided is pressed downwardly (toward the developing cartridge housing part), the developing cartridge is housed in the developing cartridge housing part, so that the mounting of the developing cartridge to the drum cartridge is completed. When detaching the developing cartridge from the drum cartridge, the other end portion of the developing cartridge is lifted up, so that the developing cartridge is pulled out from the developing cartridge housing part.

In order to prevent the developing cartridge from being unintentionally detached, from the drum cartridge, a lock lever having a contact piece is swingably provided to the developing cartridge housing part. When the developing cartridge is housed in the developing cartridge housing part, the contact piece of the lock lever is opposed to a predetermined part of the developing cartridge from an upper side. Accordingly, when the other end portion of the developing cartridge is lifted up, the predetermined part of the developing cartridge contacts the contact piece of the lock lever, so that a further lifting up is restrained. Thus, under such a state, it is not possible to pull out the developing cartridge from the developing cartridge housing part. When the lock lever is swung to release the contact piece of the lock lever from the upper side of the predetermined part of the developing cartridge, the lifting up of the other end portion of the developing cartridge is not restrained. Thus, it is possible to pull out the developing cartridge from the developing cartridge housing part and to thus detach the developing cartridge from the drum cartridge.

SUMMARY

In the above-described related-art process cartridge, in order to pull out the developing cartridge from the developing cartridge housing part to detach the developing cartridge from the drum cartridge, a user should lift up the other end portion of the developing cartridge while operating the lock lever. Thus, operability when detaching the developing cartridge from the drum cartridge may be poor.

Therefore, illustrative aspects of the invention provide a process cartridge that can improve operability when detaching a developing cartridge from a drum cartridge.

According to one aspect of the invention, there is provided a process cartridge comprising: a drum cartridge that holds a photosensitive drum; a developing cartridge, which holds a developing roller at a first end portion thereof, and which is detachably mounted to the drum cartridge; a lock member, which is provided to the drum cartridge, and which is displaceable between: a lock position at which the developing cartridge is prevented from being detached from the drum cartridge; and a lock release position at which detachment of the developing cartridge from the drum cartridge is permitted; an operation member that is operated to displace the lock member from the lock position to the lock release position; and a lifting member that lifts a second end portion opposite to the first end portion of the developing cartridge from the drum cartridge as the lock member is displaced from the lock position to the lock release position, wherein the developing cartridge comprises a developing-side holding part, which is provided to the second end portion of the developing cartridge, and which extends in a direction orthogonal to the lifting direction of the second end portion of the developing cartridge from the drum cartridge, and wherein the drum cartridge comprises a drum-side holding part that extends in parallel with the developing-side holding part while being opposed to the developing-side holding part in the lifting direction when the developing cartridge is mounted to the drum cartridge.

According to the aspects of the invention, the developing cartridge is detachably mounted to the drum cartridge that holds the photosensitive drum. The developing roller is held at the first end portion of the developing cartridge. The drum cartridge has a lock member. When the operation member is operated, the lock member is displaced from the lock position, at which the developing cartridge is prevented from being detached from the drum cartridge, to the lock release position, at which the detachment is permitted. The process cartridge has the lifting member, and the second end portion opposite to the first end portion of the developing cartridge is lifted from the drum cartridge by the lifting member as the lock member is displaced from the lock position to the lock release position.

In other words, when the operation member is operated, the state in which the developing cartridge is prevented from being detached from the drum cartridge is shifted to the state in which the detachment is permitted and the second end portion of the developing cartridge is lifted from the drum cartridge. Accordingly, when the developing cartridge is detached from the drum cartridge, it is not necessary for a user to lift up the second end portion of the developing cartridge while operating the operation member. Thus, the operability when detaching the developing cartridge from the drum cartridge is improved.

The second end portion of the developing cartridge is formed with the developing-side holding part. The drum cartridge is formed with the drum-side holding part. When the developing cartridge is mounted to the drum cartridge, the developing-side holding part is opposed to the drum-side holding part in the lifting direction with being parallel with the drum-side holding part. An interval between the developing-side holding part and the drum-side holding part becomes smaller as the process cartridge is made to be thinner.

As the second end portion of the developing cartridge is lifted, the interval between the developing-side holding part and the drum-side holding part is larger. Thus, a user can easily put a finger between the holding parts. Therefore, since the user may be able to hold the developing-side holding part conveniently, it is possible to realize the more favorable operability when detaching the developing cartridge 7 from the drum cartridge.

DETAILED DESCRIPTION

Hereinafter, exemplary embodiments of the invention will be specifically described with reference to the drawings.

(Printer)

Figure 1:
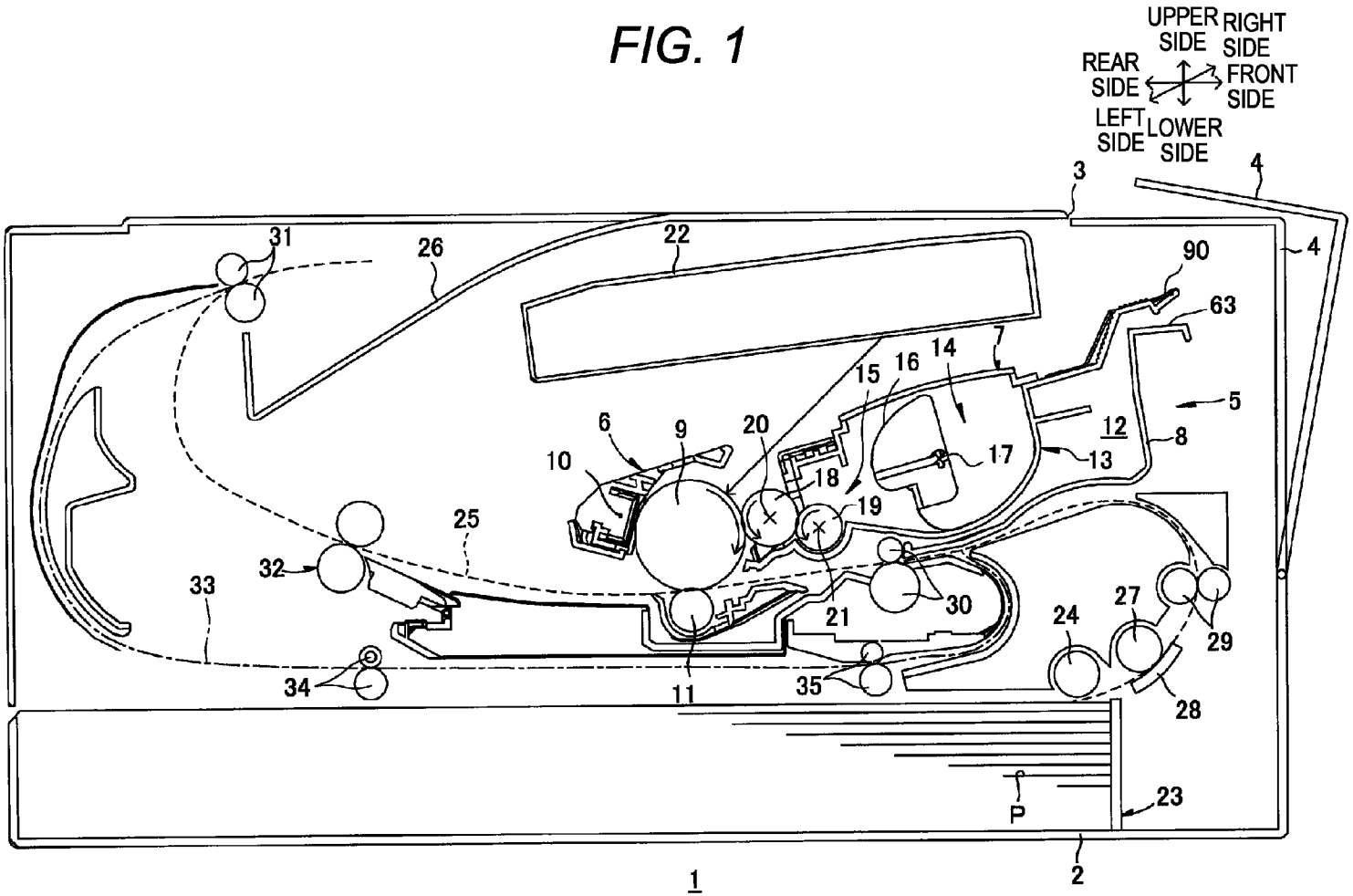
FIG. 1 is a sectional view of a laser printer to which a process cartridge according to an illustrative embodiment of the invention is mounted.

As shown in FIG. 1, a laser printer 1 (one example of an image forming apparatus) has a body casing 2 (one example of a main body). One sidewall of the body casing 2 is formed with a cartridge attaching and detaching port 3 and is provided with a front cover 4 that opens and closes the cartridge attaching and detaching port 3.

In the following descriptions, a side at which the front cover 4 is provided is referred to as a front side. The upper, lower, left and right of the laser printer 1 are set when viewed from the front side of the laser printer 1. In addition, with respect to a developing cartridge 7 (which will be described later), the front and back are set based on a state in which the developing cartridge is mounted to the body casing 2. Further, the upper, lower, left and right of the developing cartridge 7 are set when seen from the front side of the developing cartridge 7.

A process cartridge 5 is mounted in the body casing 2 at a position slightly more forward position a center. The process cartridge 5 is mounted into the body casing 2 and detached from the body casing through the cartridge attaching and detaching port 3 when the front cover 4 is opened.

The process cartridge 5 includes a drum cartridge 6 and a developing cartridge 7. The developing cartridge 7 is detachably mounted to the drum cartridge 6.

The drum cartridge 6 has a drum frame 8. A photosensitive drum 9 is rotatably held at a rear end portion of the drum frame 8. In addition, the drum frame 8 holds a charger 10 and a transfer roller 11. The charger 10 and the transfer roller 11 are arranged at front and lower sides of the photosensitive drum 9, respectively.

A part of the drum frame 8 located more forward than the photosensitive drum 9 is a developing cartridge mounting part 12. The developing cartridge 7 is mounted to the developing cartridge mounting part 12.

The developing cartridge 7 has a housing 13 that accommodates toner. In the housing 13, a toner accommodating chamber 14 and a developing chamber 15, which communicate with each other, are formed to be adjacent in a forward and backward direction.

The toner accommodating chamber 14 is provided therein with an agitator 16 so that the agitator 16 can be rotated about an agitator rotational shaft 17. The agitator rotational shaft 17 extends leftward and rightward. When the agitator 16 is rotated, the toner accommodated in the toner accommodating chamber 14 is supplied to the developing chamber 15 from the toner accommodating chamber 14 while being stirred.

A developing roller 18 and a supply roller 19 are provided to the developing chamber 15 so that the rollers can be rotated about a developing rotational axis line 20 and a supply rotational axis line 21 extending in the left-right direction, respectively. The developing roller 15 is arranged at a rear end portion (one example of a first end portion) of the housing 13 and is arranged so that a part of a circumferential surface of the developing roller is exposed to the outside of the housing 13. The developing cartridge 7 is mounted to the drum cartridge 6 so that the circumferential surface of the developing roller 18 contacts a circumferential surface of the photosensitive drum 9. The supply roller 19 is arranged so that a circumferential surface thereof contacts the circumferential surface of the developing roller 18 from a front-lower side. Toner in the developing chamber 15 is supplied to the circumferential surface of the developing roller 18 by the supply roller 19, so that the toner is carried, as a thin layer, on the circumferential surface of the developing roller 19.

In the body casing 2, an exposure device 22 that emits a laser and the like is arranged above the process cartridge 5.

When forming an image, the photosensitive drum 9 is rotated at a constant speed in a clockwise direction of FIG. 1. As the photosensitive drum 9 is rotated, the circumferential surface of the photosensitive drum 9 is uniformly charged by discharges from the charger 10. In the meantime, based on image data received from a personal computer (not shown) connected to the printer 1, a laser beam is emitted from the exposure device 22. The laser beam passes between the charger 10 and the developing cartridge 7 and irradiates the circumferential surface of the photosensitive drum 9 that is positively charged, thereby selectively exposing the circumferential surface of the photosensitive drum 9. Thus, charges are selectively removed from the exposed part of the photosensitive drum 9, so that an electrostatic latent image is formed on the circumferential surface of the photosensitive drum 9. When the electrostatic latent image faces the developing roller 18 as the photosensitive drum 9 is rotated, the toner is supplied to the electrostatic latent image from the developing roller 18. Thereby, a toner image is formed on the circumferential surface of the photosensitive drum 9.

A sheet feeding tray 23 that stacks sheets P therein is arranged on a bottom part of the body casing 2. A pickup roller 24 for sending the sheets from the sheet feeding tray 23 is provided above the sheet feeding tray 23.

Additionally, a conveyance path 25, which has an S shape when seen from the side face, is formed in the body casing 2. The conveyance path 25 reaches a sheet discharge tray 26 formed at an upper surface of the body casing 2 via a space between the photosensitive drum 9 and the transfer roller 11 from the sheet feeding tray 23. A separation roller 27 and a separation pad 28, which are arranged to be opposite to each other, a pair of feeder rollers 29, a pair of register rollers 30 and a pair of sheet discharge rollers 31 are provided on the conveyance path 25.

The sheets P sent from the sheet feeding tray 23 are separated one at a time while passing between the separation roller 27 and the separation pad 28. Then, the sheet P is conveyed toward the register rollers 30 by the feeder rollers 29. Then, the sheet P is registered by the register rollers 30 and then conveyed between the photosensitive drum 9 and the transfer roller 11 by the register rollers 30.

The toner image on the circumferential surface of the photosensitive drum 9 is electrically attracted and transferred onto the sheet P by the transfer roller 11 when the toner image faces the sheet P passing between the photosensitive drum 9 and the transfer roller 11 by the rotation of the photosensitive drum 9.

Along the conveyance path 25, a fixing device 32 is provided at a downstream, in the conveyance direction of the sheet P, side of the transfer roller 11 regarding. The sheet P, on which the toner image is transferred, is conveyed through the conveyance path 25 and passes through the fixing device 32. In the fixing device 32, the toner image becomes an image that is then fixed on the sheet P by heating and pressing.

The printer 1 has a one-sided mode of forming an image (toner image) on one side of the sheet P and a duplex mode of forming an image on one side of the sheet P and then forming an image on the other side of the sheet P, as operation modes.

In the one-sided mode, the sheet P having an image formed on one side thereof is discharged to the sheet discharge tray 26 by the sheet discharge rollers 31.

As a configuration for realizing the duplex mode, the body casing 2 includes a reverse conveyance path 33. The reverse conveyance path 33 extends between the conveyance path 25 and the sheet feeding tray 23 from the vicinity of the sheet discharge rollers 31 and is connected to a part between the feeder rollers 29 and the register rollers 30 along the conveyance path 25. A pair of first reverse conveyance rollers 34 and a pair of second reverse conveyance rollers 25 are provided along the reverse conveyance path 33.

In the duplex mode, the sheet P having an image formed on one side thereof is sent to the reverse conveyance path 33 without being discharged to the sheet discharge tray 26. Then, the sheet P is conveyed through the reverse conveyance path 33 by the first reverse conveyance rollers 34 and the second reverse conveyance rollers 35 and the two sides of the sheet are reversed, so that the other side having no image formed thereon is sent along the conveyance path 25 while facing the circumferential surface of the photosensitive drum 9. Then, an image is formed on the other side of the sheet P, so that the images are formed on both sides of the sheet P.

(Process Cartridge)

(1) Drum Cartridge (1-1) Drum Frame

Figure 2A:
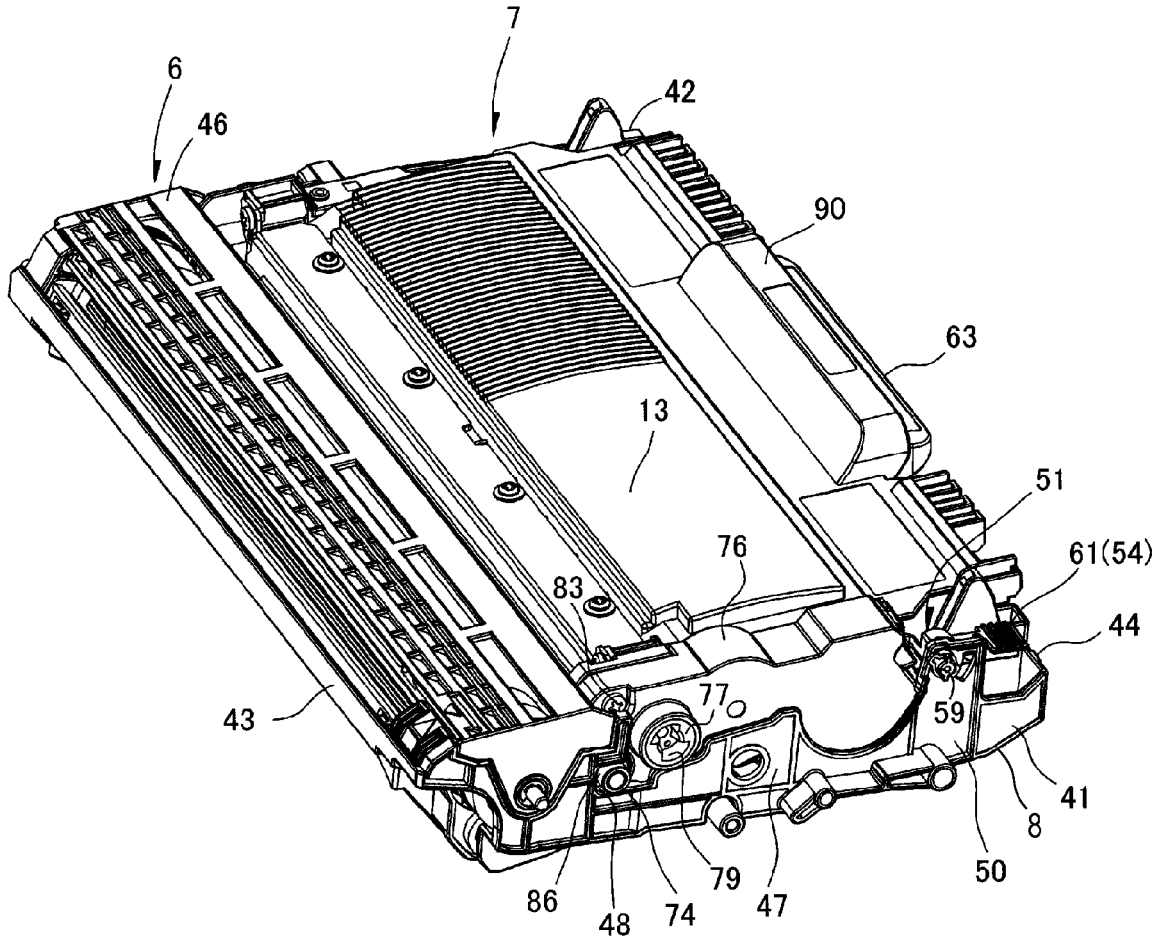
FIG. 2A is a perspective view of the process cartridge shown in FIG. 1 when seen from a left, back and upper side, showing a state in which a developing cartridge is mounted to a drum cartridge.
Figure 2B:
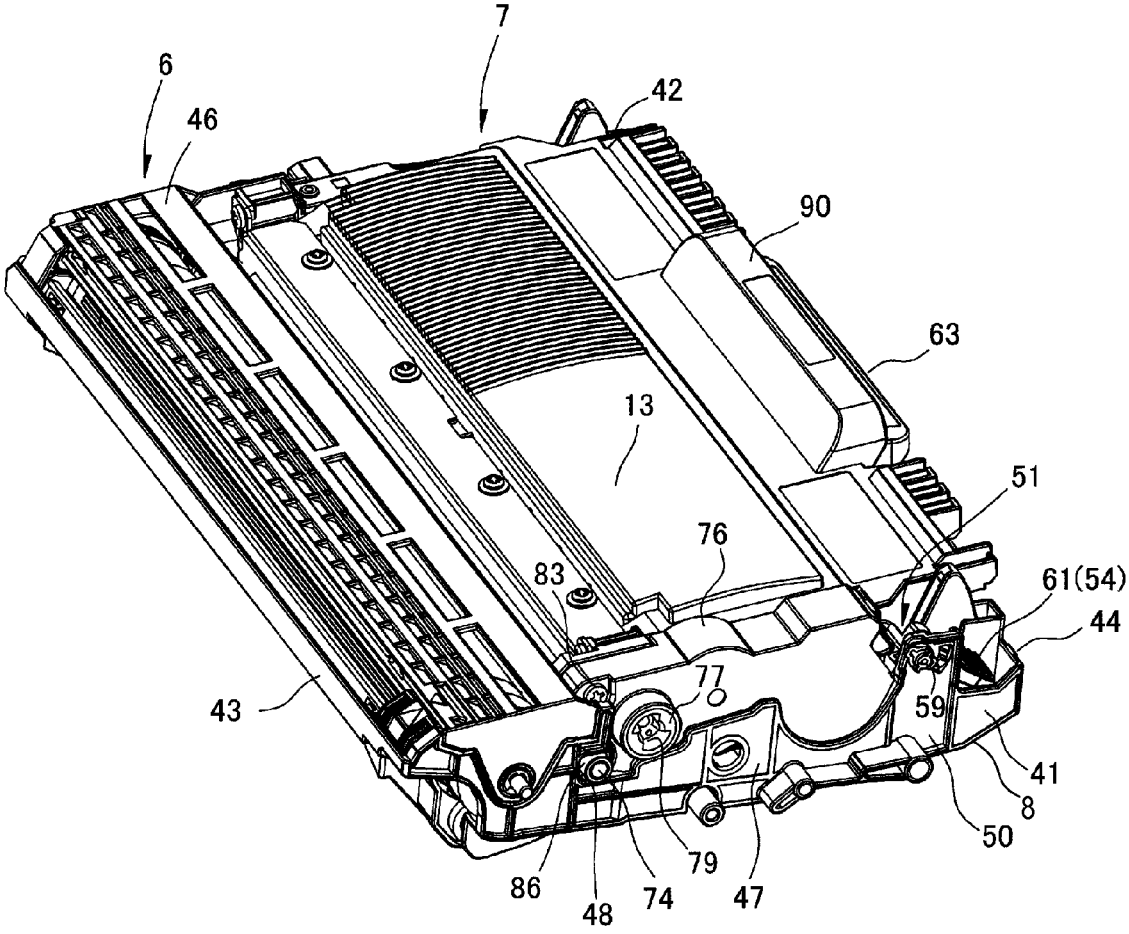
FIG. 2B is a perspective view of the process cartridge shown in FIG. 1 when seen from a left, back and upper part, showing a state in which a front end portion of the developing cartridge is lifted from the drum cartridge.
Figure 3A:
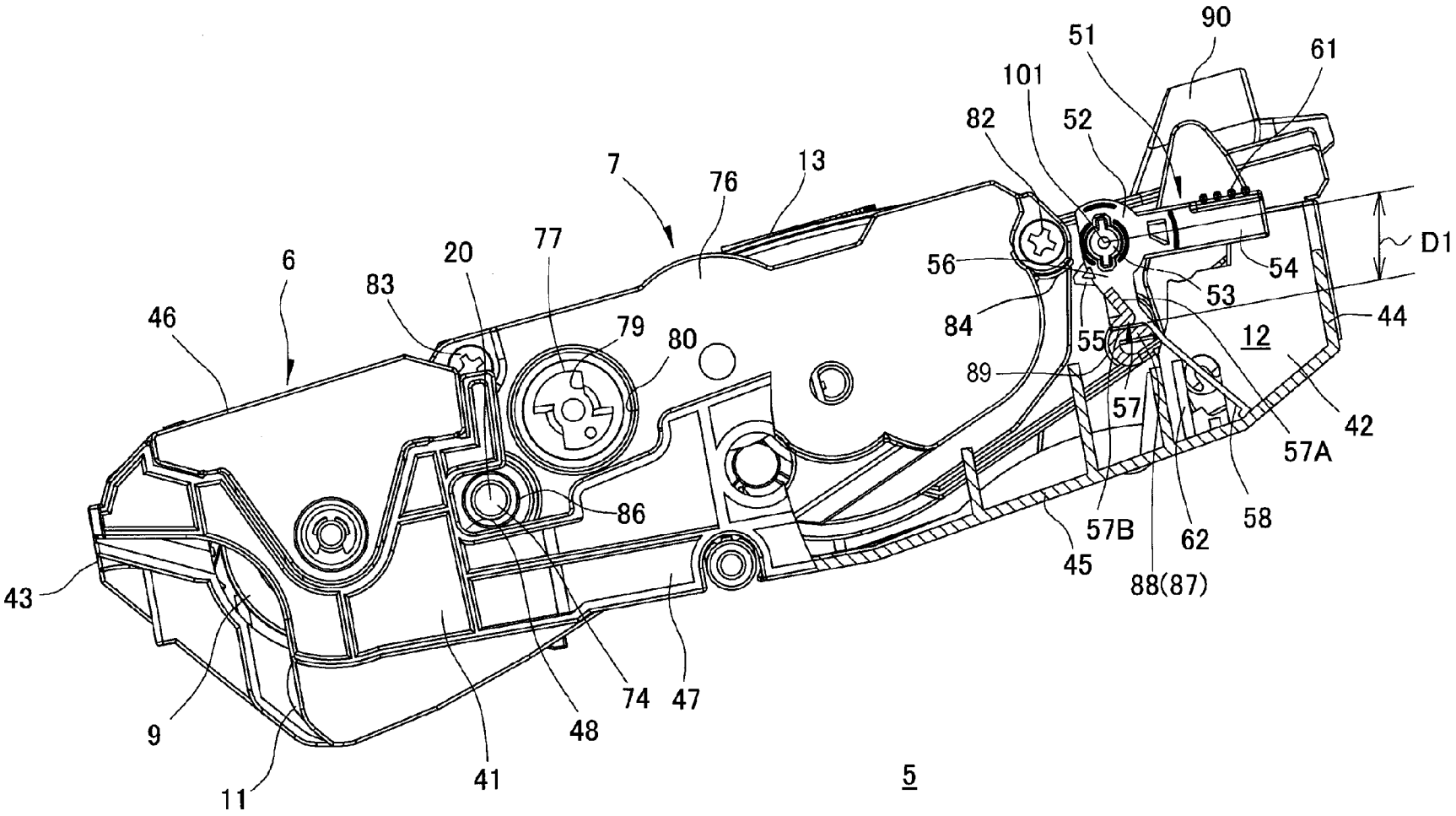
FIG. 3A is a left side view of the process cartridge shown in FIG. 2A (in which a front end portion of the drum cartridge is broken away)
Figure 3B:
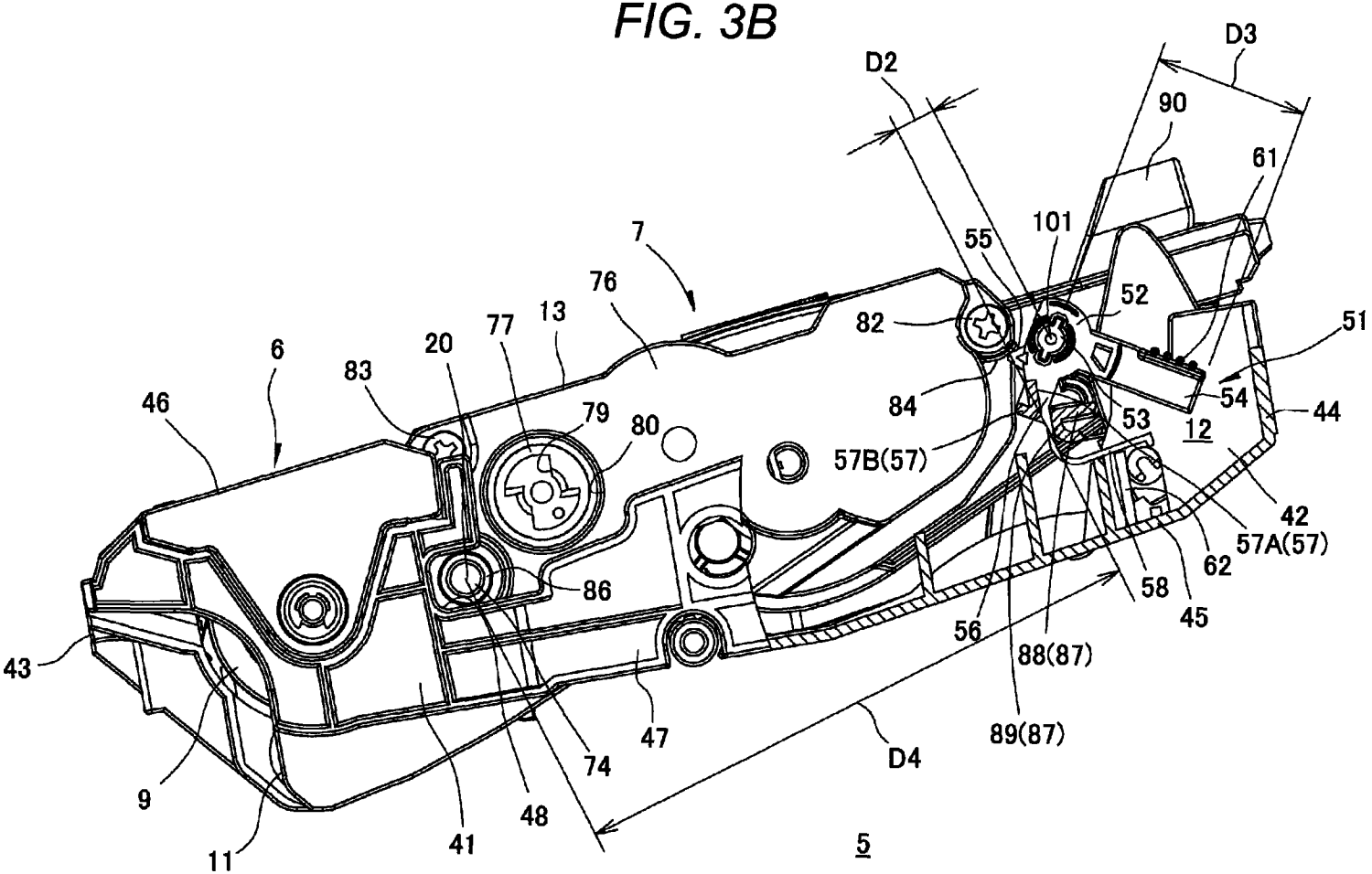
FIG. 3B is a left side view of the process cartridge shown in FIG. 2B (in which the front end portion of the drum cartridge is broken away)

As shown in FIGS. 2A and 2B, the drum frame 8 of the drum cartridge 6 has a left sidewall 41 and a right sidewall 42. The left sidewall 41 and the right sidewall 42 have an elongated plate shape extending in the front-rear direction and face each other at an interval in the left-right direction. A back side wall 43 is bridged between respective rear end portions of the left sidewall 41 and the right sidewall 42. A front side wall 44 is bridged between respective front end portions of the left sidewall 41 and the right sidewall 42. As shown in FIGS. 3A and 3B, a bottom wall 45 is bridged between respective lower end portions of the left sidewall 41 and the right sidewall 42 so as to block the lower part thereof. Thereby, the drum frame 8 has a quadrangular frame shape having a closed bottom when seen from a plan view.

As shown in FIGS. 2A and 2B, an upper side wall 46 is bridged between the respective rear end portions of the left sidewall 41 and the right sidewall 42 so as to cover the upper side wall from above. The photosensitive drum 9 and the transfer roller 11 are rotatably supported by the left sidewall 41 and the right sidewall 42 between the upper side wall 46 and the bottom wall 43. In addition, the charger 10 (refer to FIG. 1) is provided between the respective rear end portions of the left sidewall 41 and the right sidewall 42 to block a space between the rear side wall 43 and the upper side wall 46 at the rear part of the upper side wall 46.

In the space sandwiched between the left sidewall 41 and the right sidewall 42, a part that is not opposed to the upper side wall 46 and has an opened upper portion becomes the developing cartridge mounting part 12. When the developing cartridge 7 is mounted to the developing cartridge mounting part 12, parts (hereinafter, referred to as 'developing cartridge facing parts') 47 of the left sidewall 41 and the right sidewall 42, which face the developing cartridge mounting part 12, are arranged to respectively face the developing cartridge 7 at a slight interval, respectively. In addition, an upper face of the upper side wall 46 is substantially flush with an upper face of the developing cartridge 7.

A back side upper end portion of each developing cartridge facing part 47 is formed with a roller shaft receiving part 48. The roller shaft receiving part 48 has a substantially C shape having an opened front side.

(1-2) Swinging Member

Figure 4:
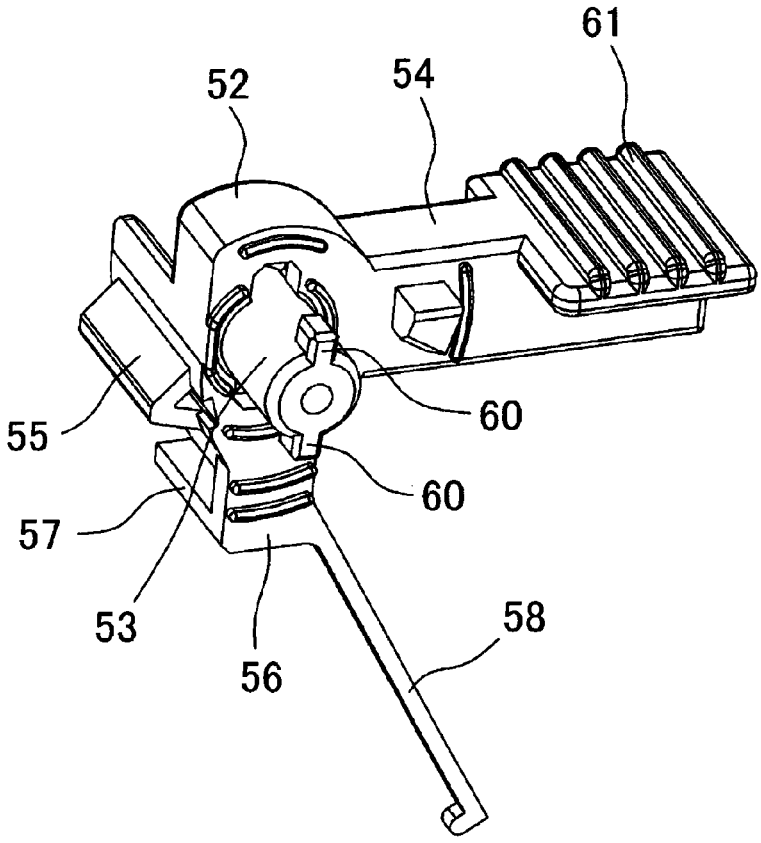
FIG. 4 is a perspective view of a swinging member shown in FIGS. 3A and 3B.

A swinging member 51 is supported to a support part 50. The swinging member 51 is made of resin. As shown in FIGS. 3A, 3B and 4, the swinging member 51 integrally includes a main body part 52, a swinging shaft 53, an operation lever 54 (one example of an operation member), a lift projection 55 (one example of a lifting member), a plate-shaped part 56, a lock member 57 and a flexible piece 58. The swinging shaft 53 extends leftward from the main body part 52. The operation lever 54 extends forward from the main body part 52. The lift projection 55 protrudes backward from the main body part 52 and has a triangular prism shape extending leftward and rightward. The plate-shaped part 56 extends downwardly from a left end portion of the main body part 52 and has a rectangular shape when seen from a side face. The lock member 57 extends rightward from a right side face of the plate-shaped part 56 and has a substantially L-shaped section. The flexible piece 58 extends in a front-lower direction from a front end portion of the plate-shaped part 56 and has a rod shape.

A leading end portion of the lift projection 55 has no corner and a surface thereof forms a curved surface that is convex toward a curved part 84, which will be described later, with being contacted to the curved part 84.

As shown in FIG. 3A, the lock member 57 has a substantially L-shaped section having a part 57A that extends in the front-lower direction and a part 57B that extends backward from a lower end portion of the part 57A.

As shown in FIGS. 2A and 2B, the support part 50 is formed at its upper part with a thorough-hole 59 that penetrates the upper part in the left-right direction. The swinging shaft 53 of the swinging member 51 is inserted into the through-hole 59 from the right side, and the swinging member 51 is swingably provided about the swinging shaft 53 serving as a support point. A left end portion of the swinging shaft 53 is formed with two convex portions 60 that are spaced at a distance of 180° (refer to FIG. 4). The convex portions 60 face the support part 50 from the left side around the through-hole 59. Thereby, the swinging shaft 53 is prevented from falling out from the through-hole 59.

A leading end portion of the operation lever 54 is also formed with a pushing part 61. The pushing part 61 protrudes leftward and rightward from the end portion and has a rectangular shape when viewed as a plane.

In addition, a front end portion of the bottom wall 45 of the drum frame 8, more specifically, a portion that is located at a more forward position than the support part 50 is formed with a rib 62 that extends leftward and rightward and protrudes upwardly. The flexible piece 58 contacts the rib 62 from the upper-front side. A leading end portion of the flexible piece 58 is bent into a hook shape in the front direction.

(1-3) Drum-Side Holding Part

As shown in FIGS. 2A and 2B, a central part of the front wall 44 of the drum frame 8 regarding the left-right direction is integrally formed with a drum-side holding part 63 having a rectangular shape that is elongated in the left-right direction when viewed as a plane.

(2) Developing Cartridge (2-1) Housing

Figure 5:
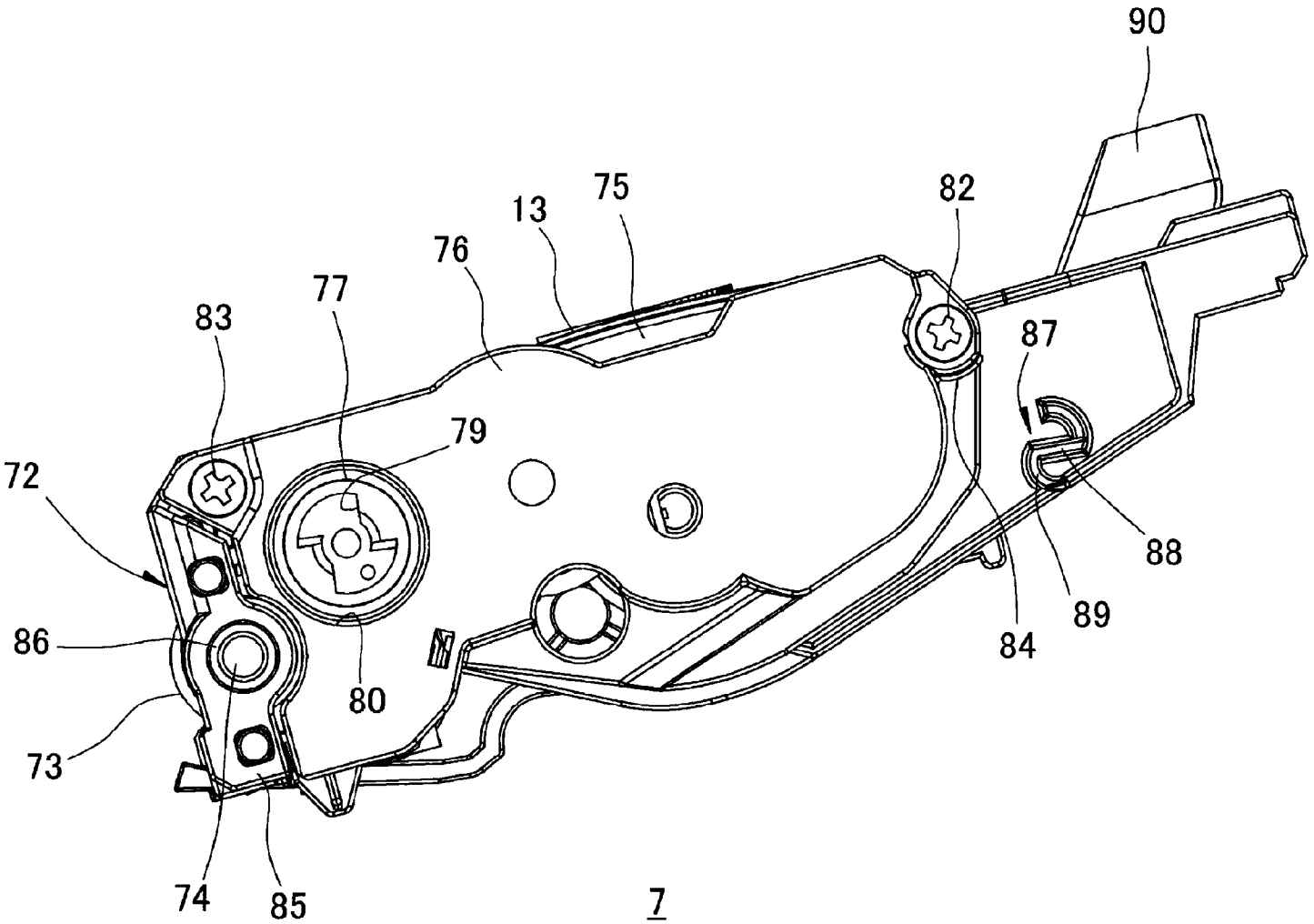
FIG. 5 is a left side view of the developing cartridge shown in FIGS. 2A and 2B.

As shown in FIGS. 2A and 2B, the housing 13 of the developing cartridge 7 has a box shape. As shown in FIG. 5, the housing 13 is formed with an opening 72 that is opened backward. The developing roller 18 is arranged so that a part of a circumferential surface thereof is exposed to the outside through the opening 72, as shown in FIG. 5.

(2-2) Developing Roller

The developing roller 18 has a cylindrical roller main body 73 having an axis line extending in the left-right direction as a center and a developing roller shaft 74 that is inserted into the roller main body 73 along the central axis line thereof. Both left and right end portions of the developing roller shaft 74 protrude from both left and right end faces of the roller main body 73, respectively. The left and right end portions of the developing roller shaft 74 are rotatably inserted into the left sidewall 41 and the right sidewall 42, respectively.

(2-3) First Gear Cover

A first gear cover 76 (one example of a cover member) is provided at an outer side of a left sidewall 75 of the housing 13. A gear train including an input gear 77 is arranged between the left sidewall 75 and the first gear cover 76.

The input gear 77 is arranged at a front-upper side regarding the developing roller 18. A left end face of the input gear 77 is formed with a connection recess portion 79. When the developing cartridge 7 (process cartridge 5) is mounted in the body casing 2 (refer to FIG. 1), a driving output member (not shown) provided in the body casing 2 is inserted in the connection recess portion 79. Driving force for rotating the developing roller 18 and the like is input to the input gear 77 from the driving output member. A left side face of the first gear cover 76 is formed with a circular opening 80 at a position facing the input gear 77. The input gear 77 is exposed to the outside through the opening 80.

The first gear cover 76 is fixed to the left sidewall 75 of the housing 13 by screws 82, 83 that are respectively inserted into the front-upper and back-upper end portions. Below the screw 82 that is inserted into the front-upper end portion, a curved part 84 (one example of an input part) having a plate shape curved into a circular arc shape along a head of the screw 82, protrudes from the left side face of the first gear cover 76. A front end portion of the curved part 84 is curved along a circumferential direction passing to a contact position of the lift projection 55 and the curved part 84, about a direction along which the front end portion of the developing cartridge 7 is lifted (which will be described below), i.e., about the rotational axis line 20 of the developing roller 18 (refer to FIG. 1).

(2-4) Second Gear Cover

At the outer side of the left sidewall 75, a second gear cover 85 is provided at a back side of the first gear cover 76. The second gear cover 85 has a rectangular shape that is long in the upper-lower direction when seen from a side face. A longitudinally central part of the second gear cover 85 is formed with a cylindrical shaft insertion penetration boss 86 that protrudes leftward. The part of the developing roller shaft 74, which protrudes to the outside from the left sidewall 41, is rotatably inserted into the shaft insertion penetration boss 86.

Incidentally, although not shown, the part of the developing roller shaft 74, which protrudes to the outside from the right sidewall 42, is inserted into a cylindrical electrode member.

In addition, the left sidewall 75 is formed at a front position of the first gear cover 76 with an engagement part 87 that protrudes leftward. The engagement part 87 integrally includes a flat plate portion 88 and a circular arc portion 89. The flat plate portion 88 has a rectangular shape when seen from a plane extending in the front-rear direction. The circular arc portion 89 extends downwardly from a rear end of the flat plate portion 88.

A central part of the front end portion of the housing 13 regarding the left-right direction is formed with a developing-side holding part 90 protruding upwardly and having a substantial C shape having an opened lower side when seen from a front side.

(3) Attachment and Detachment of Developing Cartridge to and from Drum Cartridge When the developing cartridge 7 is mounted to the drum cartridge 6, the developing cartridge 7 is arranged above the drum cartridge 6. The shaft insertion penetration boss 86 and the electrode member (not shown) are respectively contacted to the upper end edges of the left sidewall 41 and right sidewall 42 at the front of the roller shaft receiving parts 48 of the left sidewall 41 and right sidewall 42. Then, while the developing cartridge 7 is pressed backward and the shaft insertion penetration boss 86 and the electrode member are slid on the upper end edges of the left sidewall 41 and right sidewall 42, the developing cartridge 7 is moved backward. When the shaft insertion penetration boss 86 and the electrode member are received in the roller shaft receiving parts 48, the front end portion (one example of a second end portion) of the developing cartridge 7, is pressed down toward the bottom wall 45 of the drum frame 8.

While the front end portion of the developing cartridge 7 is moved downwardly, the circular arc portion 89 of the engagement part 87 is contacted to the lock member 57 (57A) from the upper side. As the front end portion of the developing cartridge 7 is further pressed, the pressing force is applied to the lock member 57 from the engagement part 87. By the pressing force, the swinging member 51 is rotated about the swinging shaft 53 serving as a support point in a direction along which the lock member 57 is moved backward. Accompanied with the rotation, the flexible piece 58 is curved so that a part between the plate-shaped part 56 and the part contacting the rib 62 protrudes in the back-lower direction, as shown in FIG. 3B.

When the front end portion of the developing cartridge 7 is further pressed and thus the engagement part 87 is moved below the lock member 57 and the engagement part 87 gets away from the lock member 57, the swinging member 51 is rotated in a direction along which the lock member 57 is moved forward, by the recovery force of the curved flexible piece 58. As a result, as shown in FIG. 3A, the lock member 57 (57B) is arranged at a lock position that is opposed to the engagement part 87 from the upper side. Thereby, the mounting of the developing cartridge 7 to the drum cartridge 6 is completed. When the developing cartridge 7 is mounted to the drum cartridge 6, the lock member 57 is opposed to the engagement part 87 from the upper side. Accordingly, even when the front end portion of the developing cartridge 7 is lifted up, the engagement part 87 contacts the lock member 57, so that the lifting up is restrained. As a result, the detachment of the developing cartridge 7 from the drum cartridge 6 is hindered.

When the developing cartridge 7 is mounted to the drum cartridge 6, the operation lever 54 extends forward and backward in substantially parallel with the bottom wall 45 of the drum frame 8. In addition, the developing-side holding part 90 is opposite to the drum-side holding part 63 at a slight interval from the upper side with being parallel with the drum-side holding part.

When detaching the developing cartridge 7 from the drum cartridge 6, the pushing part 61 of the operation lever 54 is pushed down. Thereby, the swinging member 51 is rotated about the swinging shaft 53 serving as a support point in a direction along which the lock member 57 is moved backward. Accompanied with the rotation, the flexible piece 58 is curved so that the part between the plate-shaped part 56 and the part contacting the rib 62 protrudes in the back-lower direction, as shown in FIG. 3B.

When the pushing part 61 is further pushed down, the lock member 57 is moved from the lock position to a lock release position that is deviated backward from the lock position. Also, the lift projection 55 is contacted to the curved part 84 of the first gear cover 76 from the lower side. When the pushing part 61 is further pushed down, as the swinging member 51 is rotated, the upward force is applied to the curved part 84 from the lift projection 55. By the force, the front end portion of the developing cartridge 7 is lifted up about the developing rotational axis line 20 of the developing roller 18, so that the developing cartridge 7 is detached from the drum cartridge 6.

As described above, the developing cartridge 7 is detachably mounted to the drum cartridge 6 that holds the photosensitive drum 9. The developing roller 18 is held at the rear end portion of the developing cartridge 7. The drum cartridge 6 has the lock member 57. When the operation lever 54 is operated, the lock member 57 is displaced from the lock position, at which the developing cartridge 7 is prohibited from being detached from the drum cartridge 6, to the lock release position, at which the detachment is permitted. The process cartridge 5 has the lift projection 55, and the front end portion of the developing cartridge 7 is lifted from the drum cartridge 6 by the lift projection 55 as the lock member 57 is displaced from the lock position to the lock release position.

In other words, when the operation lever 54 is operated, the state in which the developing cartridge 7 is prohibited from being detached from the drum cartridge 6 is shifted to the state in which the detachment is permitted and the front end portion of the developing cartridge 7 is lifted. Accordingly, when the developing cartridge 7 is detached from the drum cartridge 6, it is not necessary for a user to lift up the front end portion of the developing cartridge 7 while operating the operation lever 54. Thus, the operability when detaching the developing cartridge 7 from the drum cartridge 6 is improved.

The front end portion of the developing cartridge 7 is formed with the developing-side holding part 90. The drum cartridge 7 has the drum-side holding part 63. When the developing cartridge 7 is mounted to the drum cartridge 6, the developing-side holding part 90 is opposed to the drum-side holding part 63 at a slight interval from the upper side with being parallel with the drum-side holding part 90. The interval between the developing-side holding part 90 and the drum-side holding part 63 becomes smaller as the process cartridge 5 is made to be thinner.

As the front end portion of the developing cartridge 7 is lifted, the interval between the developing-side holding part 90 and the drum-side holding part 63 is larger. Thus, a user can easily put a finger between the holding parts. Therefore, since the user can hold the developing-side holding part 90 conveniently, it is possible to realize the more favorable operability when detaching the developing cartridge 7 from the drum cartridge 6.

In addition, the lock member 57, the operation lever 54 and the lift projection 55 are integrated as the swinging member 51. Thereby, it is possible to realize the two functions of releasing the prohibition of detachment of the developing cartridge 7 and lifting the front end portion of the developing cartridge by one part. Accordingly, with the simple configuration, it is possible to realize the favorable operability when detaching the developing cartridge 7 from the drum cartridge 6.

Furthermore, the swinging member 51 is provided to the swinging shaft 53 in a swingable manner. When the lock member 57 is located at the lock position, the engagement part 87 of the developing cartridge 7 is opposed to the lock member 57 from the lower side. Thereby, it is possible to securely prohibit the developing cartridge 7 from being detached from the drum cartridge 6. In addition, the developing cartridge 7 is formed with the curved part 84 that the lift projection 55 contacts. When the swinging member 51 is rotated, the lock member 57 is released from the position at which the lock member is opposed to the engagement part 87, and the force of the lifting direction is applied to the curved part 84 from the lift projection 55, so that the front end portion of the developing cartridge 7 is lifted.

Additionally, regarding the rotating direction of the swinging member 51 when the operation lever 54 is operated, the operation lever 54, the lock member 57 and the lift projection 55 are arranged in corresponding order. Accordingly, when the operation lever 54 is operated and the swinging member 51 is thus rotated, the lock member 57 is released from the position at which the lock member is opposed to the engagement part 87, and then the force of the lifting direction is applied to the curved part 84 from the lift projection 55. Thus, it is possible to smoothly realize the release of the prohibition of detachment of the developing cartridge 7 and the lifting of the front end portion of the developing cartridge 7 in corresponding order.

A straight-line distance D1 (refer to FIG. 3A) between a central axis line 101 of the swinging shaft 53 of the swinging member 51 and a contact position of the lock member 57 and the engagement part 87 is larger than a straight-line distance D2 (refer to FIG. 3B) between the central axis line 101 of the swinging shaft 53 and a contact position of the lift projection 55 and the curved part 84. Accordingly, it is possible to securely realize the release of the prohibition of detachment of the developing cartridge 7 and the lifting of the front end portion of the developing cartridge in corresponding order. As a result, it is possible to prevent the engagement part 87 and/or the lock member 57 from being damaged due to the force applied to the lock member 57 from the engagement part 87.

Furthermore, the operation lever 54 has the pushing part 61 that is pushed so as to operate the operation lever 54. A straight-line distance D3 (refer to FIG. 3B) between the central axis line 101 of the swinging shaft 53 of the swinging member 51 and the pushing part 61 (specifically, a straight-line distance between the central axis line 101 and the leading end portion of the operation lever 54) is larger than the straight-line distance D2 between the central axis line 101 of the swinging shaft 53 and the contact position of the lift projection 55 and the curved part 84. Therefore, it is possible to lift up the front end portion of the developing cartridge 7 with small force by the principle of a lever. Thus, it is possible to realize the more favorable operability when detaching the developing cartridge 7 from the drum cartridge 6.

In addition, a straight-line distance D4 between the developing rotational axis line (central axis line) 20 of the developing roller 18 and the contact position of the lift projection 55 and the curved part 84 is larger than the straight-line distance D3 (refer to FIG. 3B) between the central axis line 101 of the swinging shaft 53 of the swinging member 51 and the pushing part 61. Accordingly, it is possible to lift up the front end portion of the developing cartridge 7 with small force by the principle of a lever. Thus, it is possible to realize the more favorable operability when detaching the developing cartridge 7 from the drum cartridge 6.

The curved part 84 is a curved surface that is convex toward the lift projection 55, i.e., downwardly. Therefore, it is possible to make the lift projection 55 contact the curved part 84 smoothly.

The curved part 84 is curved along the direction along which the front end portion of the developing cartridge 7 is lifted (a circumferential direction having the developing rotational axis line 20 of the developing roller 18 as a center). Accordingly, even when the front end portion of the developing cartridge 7 is lifted, it is possible to secure the contact between the lift projection 55 and the curved part 84.

In addition, the surface of the contact part of the lift projection 55 to the curved part 84 is a curved surface that is convex toward the lift projection 55. Accordingly, the contact between the lift projection 55 and the curved part 84 is a contact between the curved surfaces. Thus, it is possible to make the lift projection 55 contact the curved part 84 more smoothly.

Further, the developing cartridge 7 has the first gear cover 76. The first gear cover 76 is attached on the side face of the developing cartridge 7 by the screws 82, 83. The curved part 84 is formed at the first gear cover 76 and is curved along the head of the screw 82. Thereby, it is possible to aesthetically design the curved part 84 and to make the lift projection 55 contact the part of the first gear cover 76, which has relatively high strength, so that it is possible to prevent the first gear cover 76 from being damaged due to the force applied from the lift projection 55. In addition, it is possible to stably lift up the front end portion of the developing cartridge 7.

What is claimed is:

1. A process cartridge comprising:

a drum cartridge configured to hold a photosensitive drum;

a developing cartridge, which is configured to hold a developing roller at a first end portion thereof, and which is configured to be detachably mounted to the drum cartridge;

a lock member, which is provided to the drum cartridge, and which is configured to displace between:

a lock position at which the developing cartridge is prevented from being detached from the drum cartridge; and a lock release position at which detachment of the developing cartridge from the drum cartridge is permitted;

an operation member configured to displace the lock member from the lock position to the lock release position; and a lifting member configured to lift a second end portion opposite to the first end portion of the developing cartridge from the drum cartridge as the lock member is displaced from the lock position to the lock release position, wherein the developing cartridge comprises:

a developing-side holding part, which is provided to the second end portion of the developing cartridge, and which extends in a direction orthogonal to the lifting direction of the second end portion of the developing cartridge from the drum cartridges;

an engagement part that is opposed to the lock member located at the lock position from an upstream side of the lifting direction; and an input part, wherein the lifting member is configured to contact the input part and apply force in the lifting direction to the input part, and wherein the drum cartridge comprises a drum-side holding part that extends in parallel with the developing-side holding part while being opposed to the developing-side holding part in the lifting direction when the developing cartridge is mounted to the drum cartridge.

2. The process cartridge according to claim 1, wherein the lock member, the operation member and the lifting member are integrated.

3. The process cartridge according to claim 2, wherein the lock member, the operation member and the lifting member are configured to swing about a swinging shaft that extends in a direction intersecting the lifting direction of the second end portion of the developing cartridge from the drum cartridge, and wherein the lock member is configured to be displaced from the lock position to the lock release position by predetermined rotation about the swinging shaft.

4. The process cartridge according to claim 3, wherein the operation member, the lock member and the lifting member are arranged in corresponding order in the predetermined direction.

5. The process cartridge according to claim 3, wherein a straight-line distance between a central axis line of the swinging shaft and a contact position between the lock member and the engagement part is larger than a straight-line distance between the central axis line of the swinging shaft and a contact position between the lifting member and the input part.

6. The process cartridge according to claim 3, wherein the operation member comprises a pushing part configured to receive a pushing force to operate the operation member, and wherein a straight-line distance between a central axis line of the swinging shaft and the pushing part is larger than a straight-line distance between the central axis line of the swinging shaft and a contact position between the lifting member and the input part.

7. The process cartridge according to claim 6, wherein a straight-line distance between a central axis line of the developing roller and a contact position between the lifting member and the input part is larger than the straight-line distance between the central axis line of the swinging shaft and the pushing part.

8. The process cartridge according to claim 1, wherein the input part is a curved surface that is convex toward the lifting member.

9. The process cartridge according to claim 8,
wherein the input part is curved along the lifting direction.

10. The process cartridge according to claim 1,
wherein a surface of the part of the lifting member, which is configured to contact the input part, is a curved surface that is convex toward the lifting member.

11. The process cartridge according to claim 1,
wherein the developing cartridge further comprises a cover member that is attached to a side of the developing cartridge in a central axis line of the developing roller, and
wherein the input part is formed at the cover member.

12. The process cartridge according to claim 11,
wherein the cover member is attached to the side of the developing cartridge by a screw, and
wherein the input part is curved along a head of the screw.

13. The process cartridge according to claim 1,
wherein the lifting member is configured to contact and lift the second end portion of the developing cartridge.

14. A process cartridge comprising:
a drum cartridge configured to hold a photosensitive drum;
a developing cartridge, which is configured to hold a developing roller at a first end portion thereof, and which is configured to be detachably mounted to the drum cartridge;
a swinging member provided near the developing cartridge, the swinging member comprising:
a main body part;
a swinging shaft, which extends orthogonally from a surface of the main body part and is configured to be inserted into a hole formed in a side of the process cartridge;
a plate-shaped part, which extends downward from main body part in a direction parallel to the surface of the main body part to form a first face continuous with the surface of the main body part, the first face facing the side of the process cartridge;
a lock member, which forms a substantially L-shape by extending in a direction away from the side of the process cartridge in a direction orthogonal to a second face of the plate-shaped part, the second face of the plate-shaped part being disposed on a side of the plate-shaped part that is opposite from the first face of the plate-shaped member, which was continuous with the surface of the main body part and which faces the side of the process cartridge,
wherein the lock member is configured to displace between:
a lock position at which the developing cartridge is prevented from being detached from the drum cartridge; and
a lock release position at which detachment of the developing cartridge from the drum cartridge is permitted;
an operation member, which extends from a side of the main body part opposite the developing cartridge in a direction away from the developing cartridge,
wherein the operation member is configured to displace the lock member from the lock position to the lock release position, and
wherein the operation member includes a pushing part, which is located at an end portion of operation member, and which extends away from the operation member in two directions orthogonal to the direction of extension of the operation member to form a rectangular shape;
a lifting member, which is located on a side of the main body part opposite from the operation member, and which has a curved surface extending convexly toward a curved part formed on a second end portion of the developing cartridge, the second end portion being on an opposite side of the developing cartridge from the first end portion of the developing cartridge,
wherein the lifting member is configured to lift the second end portion from the drum cartridge as the lock member is displaced from the lock position to the lock release position; and
a flexible piece, which has a rod shape and which extends in a direction downward, and away from the developing cartridge,
wherein the flexible piece is connected to a lower portion of the plate-shaped part on a side furthest from the developing cartridge;
wherein the developing cartridge comprises a developing-side holding part, which is provided to the second end portion of the developing cartridge, and which extends in a direction orthogonal to the lifting direction of the second end portion of the developing cartridge from the drum cartridge, and
wherein the drum cartridge comprises a drum-side holding part that extends in parallel with the developing-side holding part while being opposed to the developing-side holding part in the lifting direction when the developing cartridge is mounted to the drum cartridge.

15. A process cartridge comprising:
a drum cartridge configured to hold a photosensitive drum;
a developing cartridge, which is configured to hold a developing roller at a first end portion thereof, and which is configured to be detachably mounted to the drum cartridge,
wherein the developing cartridge comprises an engagement part, which protrudes from the developing cartridge toward a side of the process cartridge, the engagement part comprising:
a flat plate portion, which extends in a horizontal direction to form a rectangular shape, and
a circular arc portion that extends downwardly from a first end of the flat plate portion, the first end of the flat plate portion being closer to the first end portion of the developing cartridge than a second end of the flat plate portion,
wherein the circular arc portion curves toward the second end of the flat plate portion;
a swinging member provided near the developing cartridge, the swinging member comprising:
a main body part;
a swinging shaft, which extends orthogonally from a surface of the main body part and is inserted into a hole formed in a side of the process cartridge;
a plate-shaped part, which extends downward from main body part in a direction parallel to the surface of the main body part to form a first face continuous with the surface of the main body part, the first face facing the side of the process cartridge;
a lock member, which forms a substantially L-shape by extending in a direction away from the side of the process cartridge in a direction orthogonal to a second face of the plate-shaped part, the second face of the plate-shaped part being disposed on a side of the plate-shaped part that is opposite from the first face of the plate-shaped member, which was continuous with the surface of the main body part and which faces the side of the process cartridge, wherein the lock member is configured to displace between:

a lock position at which the lock member engages the circular arc portion of engagement part of the developing cartridge to prevent the developing cartridge from being detached from the drum cartridge; and a lock release position at which the lock member is disengaged from the circular arc portion to permit detachment of the developing cartridge from the drum cartridge;

an operation member, which extends from a side of the main body part opposite the developing cartridge in a direction away from the developing cartridge, wherein the operation member is configured to displace the lock member from the lock position to the lock release position, and wherein the operation member includes a pushing part, which is located at an end portion of operation member, and which extends away from the operation member in two directions orthogonal to the direction of extension of the operation member to form a rectangular shape;

a lifting member, which is located on a side of the main body part opposite from the operation member, and which has a curved surface extending convexly toward a curved part formed on a second end portion of the developing cartridge, the second end portion being on an opposite side of the developing cartridge from the first end portion of the developing cartridge, wherein the lifting member is configured to lift the second end portion from the drum cartridge as the lock member is displaced from the lock position to the lock release position; and a flexible piece, which has a rod shape and which extends in a direction downward, and away from the developing cartridge, wherein the flexible piece is connected to a lower portion of the plate-shaped part on a side furthest from the developing cartridge, wherein the developing cartridge comprises a developing-side holding part, which is provided to the second end portion of the developing cartridge, and which extends in a direction orthogonal to the lifting direction of the second end portion of the developing cartridge from the drum cartridge, and wherein the drum cartridge comprises a drum-side holding part that extends in parallel with the developing-side holding part while being opposed to the developing-side holding part in the lifting direction when the developing cartridge is mounted to the drum cartridge.

* * * * *